United States Patent [19]

Dick

[11] 4,277,891

[45] Jul. 14, 1981

[54] LENS TAPE CUTTER

[75] Inventor: Harold R. Dick, West Brookfield, Mass.

[73] Assignee: American Optical Corporation, Southbridge, Mass.

[21] Appl. No.: 159,316

[22] Filed: Jun. 13, 1980

[51] Int. Cl.[3] ..... B26B 3/00

[52] U.S. Cl. ..... 30/316; 30/355

[58] Field of Search ..... 30/316, 355, 356, 301, 30/302

[56] References Cited

U.S. PATENT DOCUMENTS

| | | | |
|---|---|---|---|
| 534,570 | 2/1895 | Norris | 30/316 |
| 606,511 | 6/1898 | Buckles | 30/316 |
| 634,892 | 10/1899 | Jenks | 30/316 |
| 2,596,851 | 5/1952 | Hansen | 30/355 |
| 2,683,312 | 7/1954 | Dover | 30/302 |
| 2,825,968 | 3/1958 | Baer | 30/355 |
| 2,990,615 | 7/1961 | Ohler | 30/316 |
| 3,004,340 | 10/1961 | Collins | 30/316 |
| 3,765,282 | 10/1973 | Crain | 30/316 |

*Primary Examiner*—Stephen G. Kunin
*Assistant Examiner*—J. T. Zatarga
*Attorney, Agent, or Firm*—Alan H. Spencer

[57] ABSTRACT

Surface protecting tape is cut away from a lens edge with an annular cutting blade after application to the lens. The blade is pressed and/or rotated into portions of the tape extending over the lens edge for cutting therethrough and freeing the lens. Knife edge serrations enhance the cutting action and blade holding means facilitates its operation.

8 Claims, 3 Drawing Figures

LENS TAPE CUTTER

BACKGROUND OF THE INVENTION

1. Field of the Invention

This invention relates to lens surface protecting procedures with particular reference to protection by taping and removal of excess tape for subsequent lens processing.

2. Description of the Prior Art

Optically finished surfaces of lens blanks requiring second side finishing are traditionally protected from scratching and other damage with variously applied coatings including an adhesively backed usually transparent cellulose tape. The tape, being of a width greater than the maximum diameter of the lens, is usually drawn from a supply role over a lens to be covered and seated thereagainst by urging the tape and lens one toward the other.

The taped lens must then be cut away from the tape supply and/or excesses of tape at its edges prior to preparation for second side machining and polishing.

Heretofore, excesses of tape have been trimmed from taped lenses with pointed hand-held knives which are caused to first pierce the tape and be guided about the lens edge.

With the usual ease and rapidity of initial application of tape to lenses, e.g. as afforded by present day dispensers and applicators, it can be appreciated that the above trimming operation becomes bottlenecking to production. It is unduly time-consuming, awkward and involves much tediousness to effect. Special attention and skills are required for proper implementation and consistency of size and position of cut around lens edges.

Accordingly, it is an object of the present invention to facilitate the trimming of taped lenses, i.e. to provide for greater ease of implementation and accuracy of size, shape and position of cut.

Another object is to accomplish the above with unusual rapidity and without need for special skills; and Still another object is to provide tape cutting means which is readily adaptable to hand or machine operation.

Other objects and advantages of the invention will become readily apparent from the following description.

SUMMARY OF THE INVENTION

The foregoing objects and advantages of the invention are accomplished with a cutter comprising an annular blade preferably having a serrated cutting edge sharpened in a manner which provides a succession of sharp points at junctures of the serrations. An annular holder supports the blade and facilitates its handling.

The blade, having an inner diameter greater than the diameter or maximum width of a lens to be trimmed, is placed over a taped lens against overhanging portions of the tape which are first pierced by the points of the blade and completely cut away with rotation of the blade and/or continued pressing into the tape.

Details of the invention will become more readily understood from the following description when taken in conjunction with the accompanying drawings.

IN THE DRAWINGS

DESCRIPTION OF THE PREFERRED EMBODIMENTS

Figure 1:
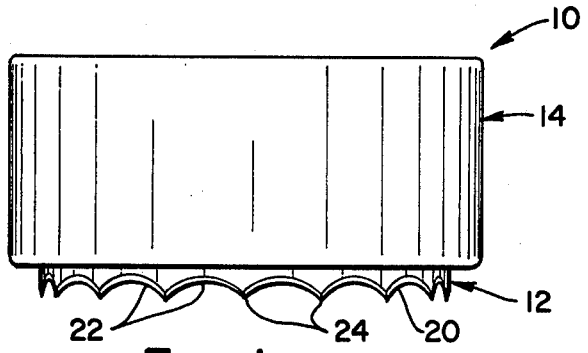
FIG. 1 is a side elevational view of a preferred embodiment of the invention.
Figure 2:
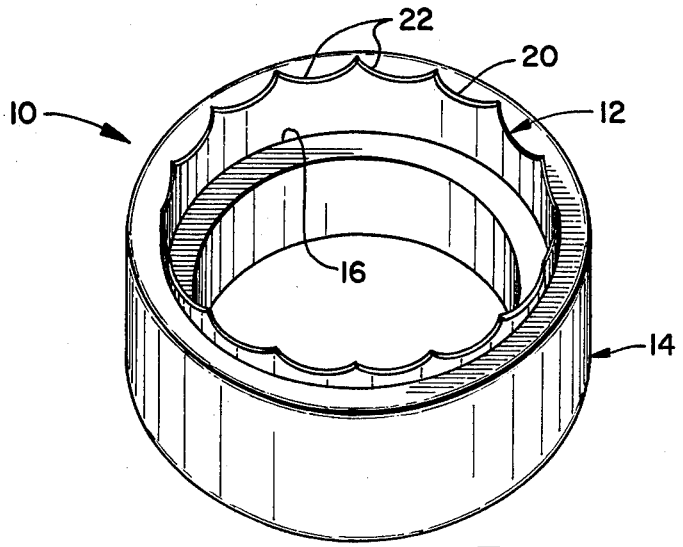
FIG. 2 is a view in perspective of the lens tape cutter of FIG. 1 illustrating its cutting blade with greater detail.

Referring to the drawings, cutter 10 comprises annular blade 12 carried by holder 14.

Holder 14 which may be formed of any suitable plastic material, e.g. polyethylene or wood or metal, is provided with annular slot 16 (FIG. 3) into which the blunt mounting edge 18 of blade 14 is seated preferably with a press fit allowing easy removal for blade sharpening or replacement.

Holder 14 provides an annular handle for manual operation of cutter 10 but may be used to adapt the cutter to machinery (not shown) for automatic operation in a manner to be described shortly relative to its hand operation.

Blade 12, which is preferably formed of a conventional knife blade steel, is serrated along its cutting edge 20. Various pitches and depths of serrations 22 may be used. A ½ inch pitch and depth of approximately ⅛ inch has proven to be highly effective in operation. While serrations 22 are presently illustrated as being scallopes of arcuate shape, it should be understood that they may be variously rectilinear in shape, e.g. V-shaped.

Blade 12 is preferably rolled into the annular configuration illustrated, bringing its opposite ends into an aligned adjacent relationship with each other. They may be butt welded if desired but need not be permanently connected together since seating in slot 16 of holder 14 retains the integrity of the illustrated annular configuration of cutting edge 20.

Edge 20 of blade 12 is sharpened by beveling to provide sharp points 24 at the junctions of serrations 22 which serve to pierce a tape to be cut by operation of the cutter 10 as follows:

Hand operation of cutter 10 is presently preferred for reduction of capital equipment investment and will be described herein with the understanding that the operation may be similarly performed with machinery. The latter merely requires adaptation of holder 14 to a suitable press having means for effecting rotation of the cutter, e.g. preferably through 20 or more degrees. A splined press spindle may be used.

Figure 3:
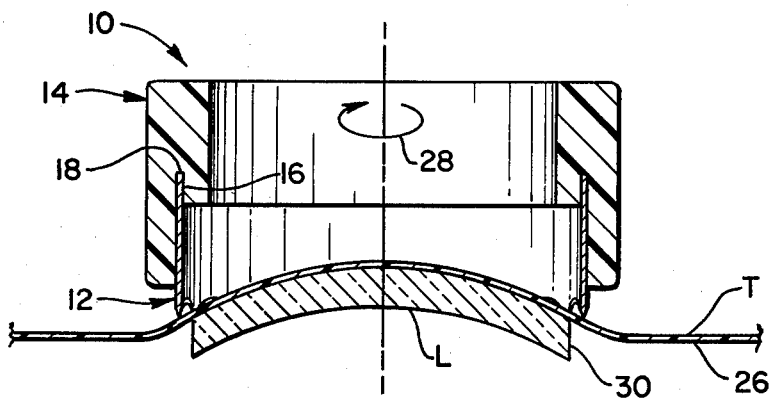
FIG. 3 is a cross-sectional view of the cutter taken in a position of use with a surface taped lens which is about to be trimmed.

Referring more particularly to FIG. 3 wherein a taped ophthalmic lens L is illustrated, tape T extended over and adhered to lens L with a pressure sensitive adhesive on its surface 26 is cut away from the lens as follows:

Cutter 10 is caused to astraddle lens L, as shown, whereafter it is pressed against tape T with a force causing points 24 to pierce the tape. Simultaneously with piercing, or thereafter, rotation of the cutter about its axis as indicated by arrow 28 effects the cutting action, i.e. a slicing of the tape by inclinations of the sharpened edges of serrations 20. Rotation in either a clockwise or counterclockwise direction, or both, will produce desired results. Continuous downward motion of blade 12 against tape T will also effect a slicing of tape T along inclinations of the sharpened edges of serrations 20. A rotation of approximately 20 degrees following or simultaneously with piercing of the tape by points 24 has proven to produce highly desirable results.

Cutter 10, accordingly, quickly and efficiently produces a uniform cut about the edge 30 of lens L. The remaining overhang of tape is controlled by selection of the diametral size of annular blade 12 used. Variously diametrally sized cutting blades 12 and correspondingly sized holders 14 may be provided to accommodate different lens diameters encountered in the field.

Blade 12 may comprise an approximately one inch wide length of 0.020 inch blade steel having an arcuately serrated (scalloped) knife edge. The blade is rolled into a circle bringing opposite ends into aligned approximately abutted relationship with each other. With one half pitch serrations, various lengths of blades for various diametral sizes of cutter 10 may be provided, e.g. 8.10 inches, 8.44 inches, 9.33 inches, or 10.06 inches for accommodating most, if not all, sizes of taped lenses needing to be trimmed.

It is to be understood that use of the term "lens" herein is intended to include all forms of the article whether surface finished on one side only as mentioned above or both sides and/or needing protection by taping and trimming for other than surfacing operations, e.g. for edge cutting, grinding or polishing.

From the foregoing it can be seen that this invention facilitates the trimming of taped lenses. Those skilled in the art, however, will readily appreciate that there are various modifications and adaptations of the precise forms of the invention here shown which may be made to suit particular requirements. Accordingly, the present forms of the invention are not to be interpreted as further restrictive than necessitated by the following claims.

I claim:

1. A tape cutter for ophthalmic lenses comprising an annular blade having opposite internal and external sides of substantial width, a sharpened serrated cutting edges and an opposite blunt mounting edge;

an annular internally recessed holder having a circular slot in said recess for receiving said mounting edge of said blade, said blade being seated in said slot with said cutting edge and a major portion of said internal side thereof exposed, the major portion of width of said external side of said blade resting against said holder.

2. A tape cutter according to claim 1 wherein serrations of said cutting edge are of arcuate configurations with successive junctions thereof forming spaced points about said cutting edge.

3. A tape cutter according to claim 2 wherein said serrations and junction points of said cutting edge are knife-edge beveled at said serrations and their junction points.

4. A tape cutter according to claim 1 wherein said slot snuggly releasably receives said blunt edge of said blade.

5. A tape cutter according to claim 1 wherein said blade comprises a continuous length of material rolled into said annular configuration with opposite ends brought into aligned adjacent relationship.

6. A tape cutter according to claim 5 wherein said ends of said length of said annular blade are abutted.

7. A tape cutter according to claim 5 wherein said ends of said length of said annular blade are connected together.

8. A tape cutter according to claim 7 wherein said ends of said blade are connected by welding.

* * * * *